United States Patent [19]

Asada et al.

[11] 4,180,399

[45] Dec. 25, 1979

[54] MOLYBDENUM BASE COMPOSITE MATERIALS REINFORCED WITH CONTINUOUS SILICON CARBIDE FIBERS AND A METHOD FOR PRODUCING THE SAME

[75] Inventors: Chiaki Asada; Makoto Saito, both of Nagoya; Hisashi Kajima, Asahi, all of Japan

[73] Assignee: The Foundation: The Research Institute for Special Inorganic Materials, Asahi, Japan

[21] Appl. No.: 834,341

[22] Filed: Sep. 19, 1977

[30] Foreign Application Priority Data

Sep. 28, 1976 [JP] Japan ..... 51/115378

[51] Int. Cl.[2] ..... B22F 3/00; C22C 29/00

[52] U.S. Cl. ..... 75/229; 75/236; 428/569

[58] Field of Search ..... 75/208 R, 211, 200, 75/229, 236; 428/569

[56] References Cited

U.S. PATENT DOCUMENTS

| | | | |
|---|---|---|---|
| 3,364,975 | 1/1968 | Gruber | 75/DIG. 1 |
| 3,432,295 | 3/1969 | Frank et al. | 75/206 |
| 3,541,659 | 11/1970 | Connell et al. | 75/DIG. 1 |
| 3,827,129 | 8/1974 | Denham et al. | 75/229 |

FOREIGN PATENT DOCUMENTS

| | | | |
|---|---|---|---|
| 2236078 | 3/1974 | Fed. Rep. of Germany | 428/569 |

*Primary Examiner*—Brooks H. Hunt

*Attorney, Agent, or Firm*—Ladas, Parry, Von Gehr, Goldsmith & Deschamps

[57] ABSTRACT

Molybdenum base composite materials having high tensile strength and oxidation resistance at high temperatures are produced by piling in parallel and embedding silicon carbide fibers containing 0.01-20% by weight of free carbon, which have been produced by the specific method already disclosed in U.S. patent application Ser. No. 677,960, in molybdenum base metallic powders and by compressing and sintering the assembly.

4 Claims, 5 Drawing Figures

X1000

MOLYBDENUM BASE COMPOSITE MATERIALS REINFORCED WITH CONTINUOUS SILICON CARBIDE FIBERS AND A METHOD FOR PRODUCING THE SAME

BACKGROUND OF THE INVENTION

1. Field of the Invention

The present invention relates to heat resistant materials reinforced with silicon carbide fibers and particularly to molybdenum base composite materials reinforced with silicon carbide fibers.

Recently, molybdenum alloys have been used in the field of air craft engine, turbine, nuclear reactor materials and the like, and the demand has been increasing but at the same time, the operating conditions have become severe and the required properties have not always been sufficient in respect to the tensile strength, softening resistance and oxidation resistance at high temperatures.

2. Description of the Prior Art

It has been attempted to increase the tensile strength of the molybdenum base materials by forming solid solutions of refractory metals, such as Nb, Ta, Zr and the like, or to increase the tensile strength of the molybdenum base materials by dispersing submicron ceramic particles, such as $ThO_2$, $Y_2O_3$ and the like, so that the tensile strength at high temperatures, particularly the shock resistance can be endured as the structure under severe operating conditions for a long period of time, but such attempts are mechanically limited and the development of more stable reinforced materials has been demanded.

It is considered as one process for preventing the softening of molybdenum alloy at higher temperatures than the above described attempts, that whiskers of SiC and the like are embedded in said alloy to reinforce said alloy. However, the whiskers are very expensive in view of the production process and are not always stable in a metal matrix at high temperatures and when using for a long period of time, diffusion reaction occurs and the tensile strength is apt to lower.

On the contrary, silicon carbide fibers according to the present invention are continuous fibers, so that the fibers are very effective as the stress medium in metal matrix and further the fibers contain free carbon, so that the reaction of the fibers with the molybdenum matrix can be prevented even under a high temperature atmosphere and it is considered that the formed composite materials have a high useful merit in a broad field.

DETAILED EXPLANATION OF THE INVENTION

Figure 1:
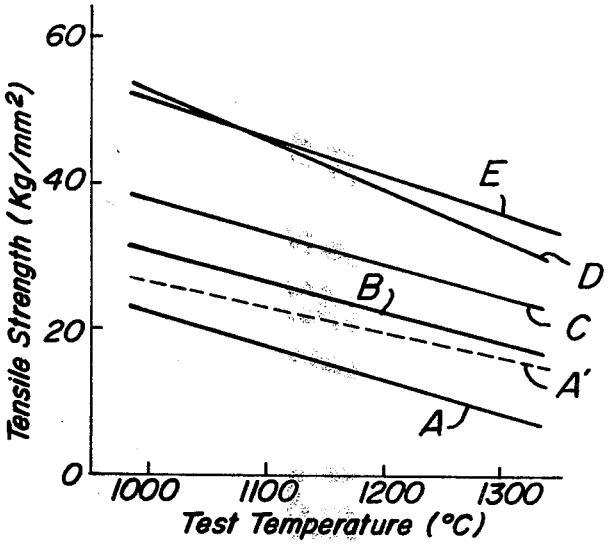
FIGS. 1 and 3 are graphical representations showing relations between the tensile strength and the test temperature of the composite materials according to the present invention and the comparative materials.

The present invention relates to molybdenum base composite materials reinforced with silicon carbide fibers containing free carbon and a method for producing the same.

Recently, materials capable of enduring super high temperatures have been demanded in a broad field and Ni-base, Co-base, Mo-base and W-base super alloys have been developed and gradually practically used. Among them, it has been attempted as one process for reinforcing molybdenum metal that molybdenum metal matrix is reinforced by ceramic fibers but satisfactory properties have not been necessarily obtained.

An object of the present invention is to provide molybdenum base composite materials reinforced with silicon carbide fibers and a method for producing the same.

It has been found that when silicon carbide fibers are used as the reinforcing material for molybdenum metal or molybdenum base alloys, free carbon contained in the silicon carbide fibers preferentially and easily reacts with molybdenum metal or molybdenum base alloy under a high temperature condition to form carbide, so that the reaction of molybdenum with carbon formed by decomposition of silicon carbide fibers is restrained and the silicon carbide fibers remain mostly in an unchanged state, and that the formed carbide improves the wettability or bonding ability of the fibers and the matrix, whereby molybdenum base composite materials having chemical stability and high tensile strength at high temperatures can be obtained.

The silicon carbide fibers to be used in the present invention must contain 0.01–20% by weight of free carbon and these fibers are provided by the method as disclosed in U.S. patent application Ser. No. 677,960.

The first aspect of the present invention consists in molybdenum base composite materials reinforced with silicon carbide fibers obtained by incorporating silicon carbide fibers containing 0.01–20% by weight of free carbon into molybdenum base metallic matrix containing not less than 40% by weight of molybdenum as an alloy element in a volume fraction of 2–80%.

The second aspect of the present invention consists in molybdenum base composite materials reinforced with silicon carbide fibers obtained by incorporating a volume fraction of 2–80% of silicon carbide fibers containing 0.01–20% by weight of free carbon into molybdenum base alloy consisting of not less than 40% by weight of molybdenum and not more than 60% by weight in total of at least one of the following metal groups (1)–(5).

(1) 8–40% by weight of Ru or 8–55% by weight of Re, (2) 0.02–8% by weight of Co or Ni, (3) 0.01–5% by weight of Ti, Zr, Nb, Ta, V, Hf or U, (4) not more than 20% by weight of W, not more than 10% by weight Cr, not more than 5% by weight of Si, not more than 10% by weight of Mn, not more than 1% by weight of Be, not more than 0.5% by weight of B or not more than 2% by weight of Cu and (5) not more than 0.5% by weight of Al, Ca, Mg, Y or at least one of rare earth metals.

The above described molybdenum base composite materials reinforced with the silicon carbide fibers are produced by piling in parallel and embedding a volume fraction of 2–80% of the above described specific silicon carbide fibers containing 0.01–20% by weight of free carbon in one metallic powders selected from three kinds of powders consisting of molybdenum metallic powders, molybdenum base alloy powders consisting of not less than 40% by weight of molybdenum and not more than 60% by weight in total of at least one of the above described metal groups (1)-(5) and the mixed powders constituting the above described molybdenum base alloys and then compressing and sintering the formed assembly to react the free carbon in the silicon carbide fibers with the metal(s) to form carbide(s) and to make the bonding ability of the silicon carbide fibers and the metal(s) higher.

The present invention can improve various properties of pure molybdenum and known molybdenum base alloys to be used at high temperatures, such as molybdenum-titanium, molybdenum-titanium-zirconium, molybdenum-tangsten-zirconium, molybdenum-niobium-titanium-zirconium and the like as shown in the following Table 1.

Table 1

| No. | Fe | Hf | Re | C | Si | Mo | Co | W | V | Nb | Ti | Zr | N |
|---|---|---|---|---|---|---|---|---|---|---|---|---|---|
| 1 | | | | 0.01–0.04 | | Remainder | 0–0.20 | | 0–1.0 | 0–1.0 | 0–0.22 | 0.01–0.08 | |
| 2 | | | | 0.30–0.75 | | 49–98 | | 0–49 | | | 1.00–8.00 | 0–0.50 | |
| 3 | | | | 0.01–0.75 | | 49–98 | | 0–49 | | | 0–5 | 0–1 | |
| 4 | | | | | 14–45 | 14–65 | | | | | 15–59 | | 1–12 |
| 5 | | | | | 14–45 | 14–65 | | | | | 15–59 | | 1–12 |
| 6 | | | | | 19–53 | 45–65 | | | | | | | 1–19 |
| 7 | | | 5–44 | | | 56–95 | | | | | | | |
| 8 | | 0.1–0.5 | | | | Remainder | | | | | 0.25–5 | | |
| 9 | | | | 0.1–0.2 | | Remainder | | | | | 1–2 | 0.1–0.7 | |
| 10 | 15–35 | | | | | 15–75 | | | | | | | |
| 1'' | | | | | | Remainder | | 5–30 | | | | | |

The silicon carbide fibers containing 0.01–20% by weight of free carbon can be produced from the organosilicon compound classified by the following groups (1)-(10).

(1) Compounds having only Si—C bond.
(2) Compounds having Si—H bond in addition to Si—C bond.
(3) Compounds having Si—Hal bond.
(4) Compounds having Si—N bond.
(5) Compounds having Si—OR bond. (R: alkyl or aryl group)
(6) Compounds having Si—OH bond.
(7) Compounds having Si—Si bond.
(8) Compounds having Si—O—Si bond.
(9) Esters of organosilicon compound, and
(10) Peroxides of organosilicon compounds.

At least one of the organosilicon compounds belonging to the above described groups (1)-(10) is subjected to a polycondensation reaction by using at least one process or irradiation, heating and addition of polycondensing catalyst to form organosilicon high molecular weight compounds having silicon and carbon as the main skeleton components. For example, the compounds having the following molecular structures are produced.

(a) 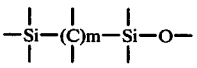

(b) 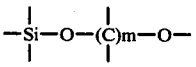

-continued (c) 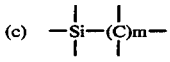

(d) The compounds having the above described skeleton components (a)-(c) as at least one partial structure in linear, ring and three dimensional structures or mixtures of the compounds having the above described skeleton components (a)-(c).

The compounds having the above described molecular structures are, for example, as follows.

(a) 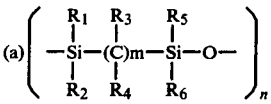

m=1, polysilmethylenesiloxane,
m=2, polysilethylenesiloxane,
m=6, polysilphenylenesiloxane,
m=12, polysildiphenylenesiloxane, (b) 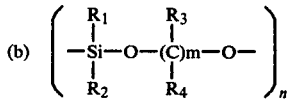

m=1, polymethyleneoxysiloxane,
m=2, polyethyleneoxysiloxane,
m=6, polyphenyleneoxysiloxane,
m=12, polydiphenyleneoxysiloxane, (c) 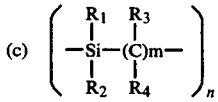

m=1, polysilmethylene,
m=2, polysilethylene,
m=3, polysiltrimethylene,
m=6, polysilphenylene,
m=12, polysildiphenylene, and (d) the compounds having the above described skeleton components as at least one partial structure in linear, ring and three dimensional structures or mixtures of the compounds having the above described skeleton components (a)-(c), wherein $R_1$-$R_6$ are hydrogen, methyl or methylene, ethyl or ethylene, phenyl or phenylene or a halogen atom, and integers n and m are in the range $2 \leqq n \leqq 500$ and $1 \leqq m \leqq 12$.

The above described organosilicon high molecular weight compounds are spun continuously and if necessary, the spun fibers are heated under an oxidizing atmosphere to form an oxidized layer on the fiber surface and are then preliminarily heated under at least one atmosphere of vacuum, an inert gas, CO gas, hydrogen gas and hydrocarbon gas and then baked at a high temperature of 1,000–2,000° C. under at least one atmosphere of vacuum, inert gas, CO gas and hydrogen gas to form continuous silicon carbide fibers having a very high strength and a high Young modulus.

The reason why the above described baking temperature is defined to be 1,000–2,000° C. is as follows. At a temperature lower than 1,000° C., conversion of organic compounds into inorganic silicon carbide in the fiber is not fully attained and the strength and Young modulus of the fibers are small, while at a temperature higher than 2,000° C., the decomposition reaction of silicon carbide becomes violent.

The ratio of silicon and carbon contained in the organosilicon high molecular weight compounds (a)–(d), which are the starting material of the above described silicon carbide continuous fibers is at least 5 atoms of carbon to 2 atoms of silicon, so that when the organosilicon high molecular weight compounds are spun and then baked, a major part of carbons bonding to the side chain of the high molecular weight compounds are converted into hydrocarbons, which are volatilized but 0.01%–20% by weight of free carbon can be remained in the silicon carbide fibers.

The molybdenum base composite materials reinforced with the silicon carbide fibers according to the present invention have such a structure that silicon carbide fibers containing 0.01–20% by weight of free carbon are piled in parallel and the gaps of the piled fibers are filled with molybdenum metal or molybdenum base alloy and the free carbon in the silicon carbide fibers reacts with the matrix metal and the bonding ability of the fibers and the matrix metal becomes higher, so that the high tensile strength can be obtained.

When silicon carbide fibers and the metal matrix are contacted at high temperatures for a long time in the sintering step of the production method of the present invention, the free carbon reacts with the matrix metal to form metal carbide and concurrently silicon carbide is decomposed, so that the sintering step is usually preferred to be within one hour.

An explanation will be made with respect to the reason of the limitation of the content of other metals in molybdenum base alloys hereinafter.

When each of ruthenium and rhenium is added to molybdenum base alloy in an amount of not less than 80% by weight, the ductility-brittleness transition temperature considerably lowers and the ductility at room temperature is increased. On the other hand, even if more than 40% by weight of ruthenium or more than 55% by weight of rhenium is added, the improved effect is small, so that the contents of ruthenium and rhenium must be 8–40% by weight and 8–55% by weight respectively.

Cobalt and nickel are effective for improving the tensile strength at high temperatures of molybdenum base alloy but the addition of a larger amount lowers the melting temperature and is economically disadvantageous, so that said amount must be 0.02–8% by weight.

Titanium, zirconium, niobium, tantalum, vanadium, hafnium and uranium react with carbon and nitrogen in molybdenum base alloy to form stable carbides or nitrides to improve the creep rupture strength at high temperatures, and further when the silicon carbide fibers containing the free carbon are incorporated into the molybdenum base alloy containing the above described elements, the free carbon in the silicon carbide fibers and the above described elements in the molybdenum base alloy form more stable carbides than molybdenum carbide at the boundary between the silicon carbide fibers and molybdenum base alloy to improve the bonding ability, to improve the workability, particularly the ductility of molybdenum base alloy material, to raise the recrystallization temperature and improve the heat resistance, and to increase the shear resistance of the boundary at high temperatures and to increase the tensile strength at high temperatures.

When the above described titanium, zirconium, niobium, tantalum, vanadium, hafnium and uranium is less than 0.01% by weight, the above described effect is few, while when the content is more than 5% by weight, the improving effect is decreased, so that the amount must be 0.01–5% by weight.

The addition of tungsten, chronium, silicon, manganese, beryllium, boron and cupper is effective for improving the tensile strength at high temperatures of molybdenum metal matrix but the addition of a large amount considerably deteriorates the ductility at room temperature of molybdenum base alloy, so that tungsten must be not more than 20% by weight, chronium must be not more than 10% by weight, silicon must be not more than 5% by weight, manganese must be not more than 10% by weight, beryllium must be not more than 1% by weight, boron must be not more than 0.5% by weight and cupper must be not more than 2% by weight.

Aluminum, calcium, magnesium, yttrium and rare earth metals are the elements effective for improving oxidation resistance and corrosion resistance but the addition of a large amount deteriorates the purity of molybdenum base alloys and lowers the toughness, so that aluminum must be not more than 0.5% by weight, calcium must be not more than 0.5% by weight, magnesium must be not more than 0.5% by weight, yttrium must be not more than 0.5% by weight and rare earth metals must be not more than 0.5% by weight.

The following examples are given for the purpose of illustration of this invention and are not intended as limitations thereof. In the examples, "%" and "part" mean by weight unless otherwise indicated.

EXAMPLE 1

An example for producing the continuous silicon carbide fibers to be used in the present invention will be explained hereinafter.

Dimethyldichlorosilane and sodium were reacted to produce polydimethylsilane. 250 g of polydimethylsilane was charged in an autoclave having a capacity of 1 l and air in the autoclave was substituted with argon gas and then the reaction was effected at 470° C. for 14 hours. After completion of the reaction, the formed polycarbosilane was discharged as n-hexane solution. This n-hexane solution was filtrated to remove impurities and then n-hexane was evaporated under a reduced pressure, after which the residue was heated in an oil bath at 280° C. under vacuum for 2 hours to effect concentration. Polycarbosilane was obtained in a yield of 40% based on dimethyldichlorosilane. A number average molecular weight of the formed polycarbosilane was 1,700. By using a usual spinning apparatus, the polycarbosilane was heated and melted at 330° C. under argon atmosphere to form a spinning melt and the spinning melt was spun at a spinning rate of 200 m/min to obtain polycarbosilane fibers. The fibers were heated by raising the temperature from 20° C. to 190° C. in air 6 hours and this temperature was kept for 1 hour to effect an unfusing treatment. The thus treated fibers were heated to 1,300° C. at a temperature raising rate of 100° C./hr under vacuum of $1\times10^{-3}$ mmHg and this temperature was kept for 1 hour to form SiC fibers. The formed SiC fibers had, for example an average diameter of 10 μm, an average tensile strength of 350 kg/mm$^2$, an average Young's modulus of $23\times10^3$ kg/mm$^2$ and a specific gravity of 2.70 g/cm$^3$.

To powders containing more than 99.6% of Mo was added 0.5% of zinc stearate as a lubricant and the resulting mixture was charged in a mold having a breadth of 10 mm and a length of 100 mm and silicon carbide fibers containing 5% of free carbon and having an average diameter of 20μ were piled in parallel and embedded in volume fractions of 1.5, 20 and 50%. Then, the mold was subjected to a press pressure of about 8 ton/cm$^2$ to form a compressed body having a thickness of about 10 mm.

For the comparison, a forged material of the above described molybdenum was prepared and a compressed body was prepared by using the above described molybdenum powders without adding the silicon carbide fibers under the same condition. The volume fraction of the silicon carbide fibers contained in the compressed body samples is shown in the following Table 2.

Table 2

| Sample | Volume fraction of SiC fibers (%) | Remarks |
|---|---|---|
| A | 0 | Comparative material |
| B | 1 | " |
| C | 5 | Present invention |
| D | 20 | " |
| E | 50 | " |
| A' | 0 | Forged material |

Five compressed bodies in Table 2 were sintered at a temperature of 1,320° C. for 1 hour under vacuum of about $10^{-4}$ mmHg. From the formed sintered bodies and the forged material, small size of pieces for testing tensile strength and creep rupture strength were cut off and the tensile strength and the creep rupture strength were measured with respect to these test pieces at a temperature of 1,000°-1,300° C. The obtained results are shown in FIGS. 1 and 2.

Figure 2:
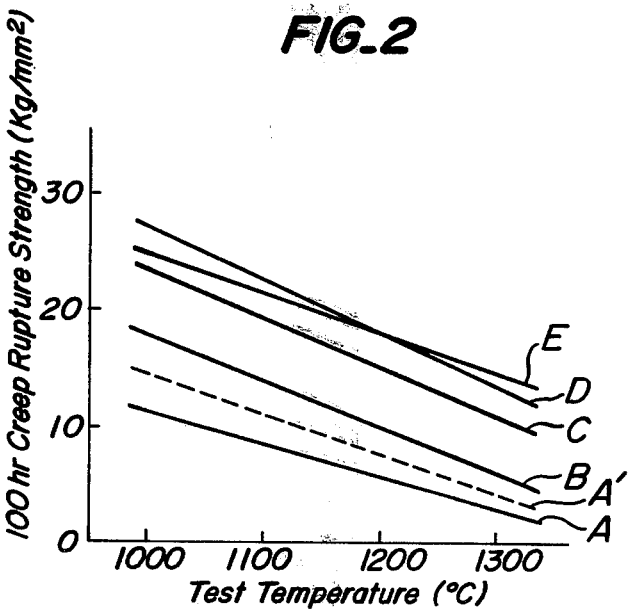
FIGS. 2 and 4 are graphical representations showing relations between the creep rupture strength and the test temperature of the composite materials according to the present invention and the comparative materials.

As seen from FIG. 1, the compressed body (B) in which the silicon carbide fibers are embedded in a volume fraction of 1%, is apparently improved in the tensile strength at high temperatures as compared with the compressed body (A) wherein the silicon carbide fibers are not embedded but the increasing ratio is small. The tensile strength at high temperatures of the compressed bodies (C), (D) and (E) wherein the silicon carbide fibers are embedded in a volume fraction of more than 5%, are very high at the effect of the incorporation of the silicon carbide fibers is noticeably recognized. This tendency is observed similarly in the case of the creep rupture strength in FIG. 2.

EXAMPLE 2

To molybdenum powders were mixed 0.5% of titanium powders and 0.1% of zirconium powders and 0.5% of zinc stearate was mixed therein as a lubricant. The resulting mixture was charged in a mold of a breadth of 10 mm and a length of 100 mm and silicon carbide fibers containing 1.0% of free carbon and an average diameter of 20μ were piled in parallel and embedded in the powder mixture in volume fractions of 10% and 40%. Then the mold was subjected to a press pressure of about 8 ton/cm$^2$ to prepare compressed bodies having a thickness of about 10 mm.

For comparison, a forged material having the same composition as the above described alloy was prepared and a compressed body wherein silicon carbide fibers not containing free carbon were embedded in a volume fraction of 40%, was prepared under the same condition as described above. The volume fraction of the silicon carbide fibers contained in the compressed bodies is shown in the following Table 3.

Table 3

| Sample | Volume fraction of SiC fibers (%) | Remarks |
|---|---|---|
| F | 0 | Comparative material |
| G | 10 | Present invention |
| H | 40 | " |
| I | 40 | SiC fibers do not contain free carbon |
| F' | 0 | Forged material |

Four compressed bodies in Table 3 were sintered at 1,320° C. for 1 hour under vacuum of about $10^{-4}$ mmHg. From the formed sintered bodies and the forged material, small size of pieces for testing tensile strength and creep rupture strength were cut off and the tensile strength and the creep rupture strength were measured with respect to these test pieces at a temperature of 1,000°-1,300° C. The obtained results are shown in FIGS. 3 and 4.

Figure 3:
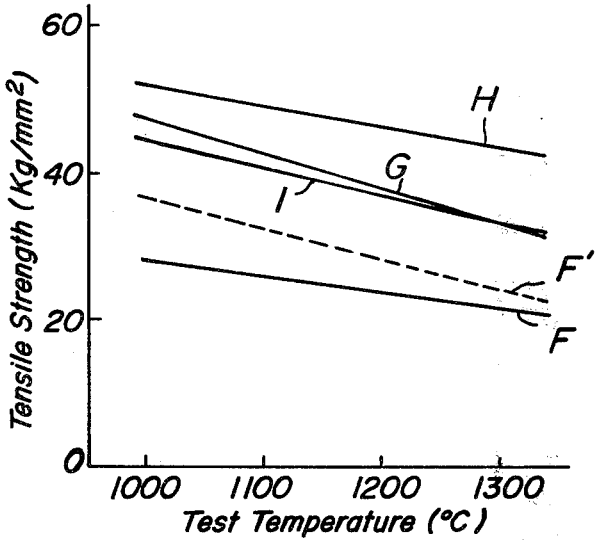

As seen from FIG. 3, the tensile strengths at high temperatures of the compressed bodies (G) and (H) containing the silicon carbide fibers in volume fractions of 10% and 40% are far higher than those of the compressed body (F) containing no silicon carbide fibers and the forged material (F'). The tensile strength at high temperatures of the compressed body (I) wherein silicon carbide fibers containing no free carbon are embedded in a volume fraction of 40%, is apparently lower than that of the compressed body (H) wherein the silicon carbide fibers containing free carbon are embedded in a volume fraction of 40%.

Figure 4:
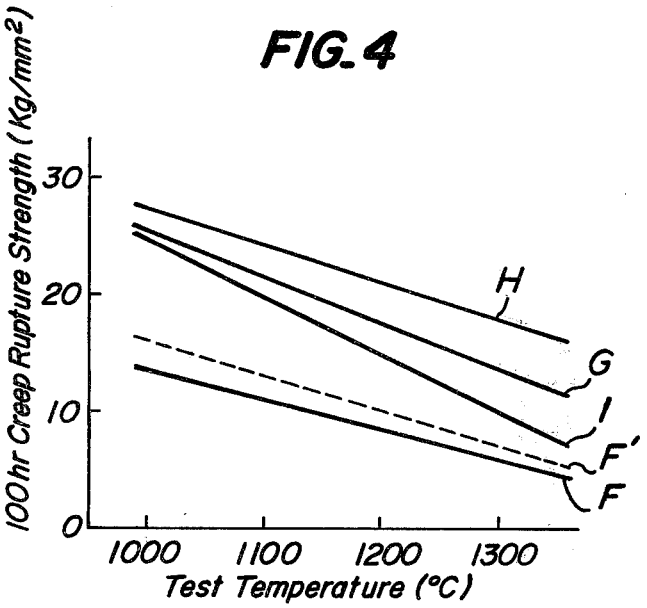

This tendency is observed similarly in the creep rupture strength in FIG. 4.

Figure 5:
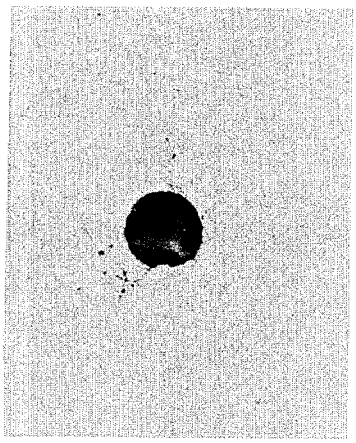
FIG. 5 is a microscopic photograph showing the cohesion state of the silicon carbide fibers and the matrix in the composite material of the present invention.

FIG. 5 shows a microscopic photograph (magnification: 1,000 times) showing the cohesion state of the silicon carbide fibers and the matrix in the composite material (G) of the present invention.

This shows that the silicon carbide fibers containing no free carbon react with the matrix metal upon sintering and the shear strength of the silicon carbide fibers lowers, while the silicon carbide fibers containing free carbon as in the present invention do not cause the above described phenomenon and the tensile strength at high temperatures is noticeably improved.

What is claimed is:

1. Molybdenum base composite materials reinforced with silicon carbide fibers obtained by incorporating silicon fibers containing 0.01–20% by weight of free carbon into a molybdenum base metallic matrix containing no less than 40% by weight of molybdenum as an alloy element in a volume fraction of 2–80%; and wherein the silicon carbide fibers are made by a process which comprises the following steps:

(a) preparing a spinning solution from at least one organosilicon high molecular weight compound having a softening point of higher than 50° C., in which silicon and carbon are the main skeleton components, and spinning said spinning solution into fibers, (b) preliminarily heating the spun fibers at a temperature of 350°–800° C. under vacuum to volatilize low molecular weight compunds contained therein, and (c) baking the thus treated fibers at a temperature of 1,000°–2,000° C. under vacuum or at least one non-oxidizing atmosphere selected from the group consisting of an inert gas, CO gas and hydrogen gas, to form silicon carbide fibers.

2. Molybdenum base composite materials reinforced with silicon carbide fibers obtained by incorporating a volume fraction of 2–80% of silicon carbide fibers containing 0.01–20% by weight of free carbon into molybdenum base alloy consisting of not less than 40% by weight of molybdenum and not more than 60% by weight in total of at least one of the following metal groups (1)–(5).

(1) 8–40% by weight of Ru or 8–55% by weight of Re, (2) 0.02–8% by weight of Co or Ni, (3) 0.01–5% by weight of Ti, Zr, Nb, Ta, V, Hf, or U, (4) not more than 20% by weight of W,
not more than 10% by weight of Cr,
not more than 5% by weight of Si,
not more than 10% by weight of Mn,
not more than 1% by weight of Be,
not more than 0.5% by weight of B or
not more than 2% by weight of Cu and (5) not more than 0.5% by weight of Al, Ca, Mg, Y or at least one of rare earth metals; and wherein the silicon carbide fibers are made by a process which comprises the following steps:

(a) preparing a spinning solution from at least one organosilicon high molecular weight compound having a softening point of higher than 50° C., in which silicon and carbon are the main skeleton components, and spinning said spinning solution into fibers, (b) preliminarily heating the spun fibers at a temperature of 350°–800° C. under vacuum to volatilize low molecular weight compounds contained therein, and (c) baking the thus treated fibers at a temperature of 1,000°–2,000° C. under vacuum or at least one non-oxidizing atmosphere selected from the group consisting of an inert gas, CO gas, and hydrogen gas, to form silicon carbide fibers.

3. Molybdenum base composite materials reinforced with silicon carbide fibers obtained by incorporating silicon carbide fibers containing 0.01–20% by weight of free carbon into molybdenum base metallic matrix containing not less than 40% by weight of molybdenum as an alloy element in a volume fraction of 2–80%; and wherein the silicon carbide fibers are made by a process which comprises the following steps:

(a) subjecting polysilanes having a Si—Si bond and which have no halogen atoms to a polycondensation reaction by at least one process of addition of a polycondensation catalyst, irradiation and heating to produce polycarbosilanes containing no halogen atoms, (b) reducing the content of low molecular compounds contained in said polycarbosilanes by treating the above described polycarbosilanes with at least one treatment of a solvent, aging said polycarbosilanes at a temperature of 50°–700° C. and distilling said polycarbosilanes at a temperature of 100°–500° C., to produce the polycarbosilanes having a softening point of higher than 50° C., (c) dissolving the thus treated polycarbosilanes in a solvent or melting said polycarbosilanes to prepare a spinning solution or spinning melt, and spinning said spinning solution or spinning melt into filaments, and (d) baking the thus treated filaments at a temperature of 2,000° C., under vacuum or at least one non-oxidizing atmosphere selected from the group consisting of an inert gas, CO gas and hydrogen gas to form silicon carbide fibers.

4. Molybdenum base composite materials reinforced with silicon carbide fibers obtained by incorporating a volume fraction of 2–80% of silicon carbide fibers containing 0.01–20% by weight of free carbon into molybdenum base alloy consisting of not less than 40% by weight of molybdenum and not more than 60% by weight in total of at least one of the following metal groups (1)–(5).

(1) 8–40% by weight of Ru or 8–55% by weight of Re, (2) 0.02–8% by weight of Co or Ni, (3) 0.01–5% by weight of Ti, Zr, Nb, Ta, V, Hf, or U, (4) not more than 20% by weight of W,
not more than 10% by weight of Cr,
not more than 5% by weight of Si,
not more than 10% by weight of Mn,
not more than 1% by weight of Be,
not more than 0.5% by weight of B or
not more than 2% by weight of Cu and (5) not more than 0.05% by weight of Al, Ca, Mg, Y or at least one of rare earth metals; and wherein the silicon carbide fibers are made by a process which comprises the following steps:

(a) subjecting polysilanes having a Si—Si bond and which have no halogen atoms to polycondensation reaction by at least one process of addition of a polycondensation catalyst, irradiation and heating to produce polycarbosilanes containing no halogen atoms, (b) reducing the content of low molecular weight compounds contained in said polycarbosilanes by treating the above described polycarbosilanes with at least one treatment of a solvent, aging said polycarbosilanes at a temperature of 50°–700° C. and distilling said polycarbosilanes at a temperature of 100°–500° C., to produce the polycarbosilanes having a softening point of higher than 50° C., (c) dissolving the thus treated polycarbosilanes in a solvent or melting said polycarbosilanes to prepare spinning solution or spinning melt, and spinning said spinning solution or spinning melt into filaments, and (d) baking the thus treated filaments at a temperature of 1,000°–2,000° C., under vacuum or at least one non-oxidizing atmosphere selected from the group consisting of an inert gas, CO gas and hydrogen gas to form silicon carbide fibers.

* * * * *